United States Patent [19]

Yamori et al.

[11] Patent Number: 4,647,951

[45] Date of Patent: Mar. 3, 1987

[54] HEAT-SENSITIVE RECORDING MATERIAL

[75] Inventors: Tsunefumi Yamori, Kobe; Sigekazu Syuku, Nara; Hironari Fujioka, Takatsuki, all of Japan

[73] Assignee: Kanzaki Paper Manufacturing Co., Ltd., Japan

[21] Appl. No.: 877,732

[22] Filed: Jun. 24, 1986

[30] Foreign Application Priority Data

Jul. 1, 1985 [JP] Japan ..... 60-145197

[51] Int. Cl.[4] ..... B41M 5/18

[52] U.S. Cl. ..... 346/200; 346/226; 427/152

[58] Field of Search ..... 346/200, 207, 226; 427/150–152

[56] References Cited

U.S. PATENT DOCUMENTS 4,370,370 1/1983 Iwata et al. ..... 346/200

FOREIGN PATENT DOCUMENTS 0025987 2/1983 Japan ..... 346/226

*Primary Examiner*—Bruce H. Hess

*Attorney, Agent, or Firm*—Larson and Taylor

[57] ABSTRACT

Disclosed is a heat-sensitive recording material comprising a base sheet, a heat-sensitive record layer formed over the base sheet and a water-soluble resin protective layer formed over the heat-sensitive record layer, characterized in that the protective layer contains at least one compound selected from the group consisting of polyaluminumhydroxide represented by the formulas $$[Al_2(OH)_aX_{6-a}]_n \quad (I)$$

$$[Al_2(OH)_a(SO_4)_{(6-a)/2}]_n \quad (II)$$

wherein X represents halogen ion or $NO_3^-$, $O<a<6$ and $1<n\leqq 20$, and a metal salt of unsaturated aliphatic carboxylic acid represented by the formula $$M_bA_cY_d \quad (III)$$

wherein M represents a metal having a valence of 2, 3 or 4, A represents unsaturated aliphatic carboxylic acid residue, Y represents halogen ion, $OH^-$, $SO_4^{2-}$ or $NO_3^-$, b is an integer of 1 or 2, c is an integer of 1 to 8, d is 0 or an integer of 1 to 8, with the proviso that $$ck_2+dk_3=bk_1$$

wherein $k_1$, $k_2$ and $k_3$ are the valences of M, A and Y, respectively.

9 Claims, No Drawings

HEAT-SENSITIVE RECORDING MATERIAL

This invention relates to heat-sensitive recording materials, and more particularly to heat-sensitive recording materials having outstanding image density retentivity and capable of giving excellent record image even after being subjected to flexographic printing.

Heat-sensitive recording materials are well known which make use of the color forming reaction of a color forming material with a color developing material which develops a color on contact with the color forming material, such that the two materials are brought into contact with each other by heating to produce a color image. These heat-sensitive record materials are relatively inexpensive, and recording devices are compact and relatively easy to maintain. Accordingly such materials are widely used as recording media for facsimile systems, computers and the like.

However, the heat-sensitive recording material is generally low in resistance to organic solvents, water, plasticizers and the like. Therefore, it has the drawback that upon contact with organic solvents, water, plasticizers (as contained in plastics film) or the like, the color image formed tends to reduce its density or the white background portion tends to undergo undesired development of color (fogging).

In order to obviate the foregoing drawbacks, it has been proposed to coat a heat-sensitive record layer either with an aqueous emulsion of a resin having ability to form a film and resistanace to chemicals (Unexamined Japanese Patent Publication No.54-128347) or an aqueous solution containing polyvinyl alcohol or like water-soluble polymer (Unexamined Japanese Utility Model Publication No.56-125354). However, these proposals do not give a heat-sensitive recording material which has satisfactory resistance to organic solvents, water, plasticizers and the like. Furthermore, due to the use of such aqueous emulsion or aqueous solution, the proposals even entail different drawbacks which would not otherwise be caused. For example, these aqueous coating compositions applied to a heat-sensitive record layer should be dried at a controlled low temperature so as to prevent any unintentional color formation on the heat-sensitive record layer which would occur if the drying temperature is exceedingly high. Accordingly, the resin layer formed upon drying is not fully cured, and causes the phenomenon that the resin layer sticks to the thermal head (the phenomenon will hereinafter be referred to as "sticking") or causes the phenomenon that the resin component and the like adhere to and are piled up on the thermal head as residuary substances.

The prior art heat-sensitive recording materials, when subjected to flexographic printing and then to recording by application of heat, have additional drawback that the color image produced on a flexographically printed heat-sensitive recording material tends to be defectively discontinuous, or that the recorded portion tends to become irregularly protuberant or have projections and recesses over the surface thereof.

It has also been proposed to add a curing agent such as glyoxal to the water-soluble resin layer. However, the proposal gives heat-sensitive recording materials which are improved to some but not full extent in image density retentivity and ability to prevent sticking. Furthermore, the proposal is still unable to overcome the foregoing problem involved in producing color images on flexographically printed heat-sensitive recording materials. Further, the proposal poses another problem that the curing agent used reduces the pot life of a coating composition for forming a resin layer.

Heretofore, satisfactory results have not been obtained in respect of image density retentivity under severe conditions such as those requiring resistance to plasticizers and water at the same time or resistance to plasticizers for a prolonged period of time, and in respect of ability to prevent sticking.

It is an object of this invention to provide a heat-sensitive recording material having high resistance to organic solvents, water, plasticizers and the like and thus outstanding image density retentivity.

It is another object of the invention to provide a heat-sensitive recording material capable of producing the desired color images even after being subjected to flexographic printing.

It is a further object of the invention to provide a heat-sensitive recording material which is free from sticking and the problem of the residuary substances being piled up on the thermal head.

This invention provides a heat-sensitive recording material comprising a base sheet, a heat-sensitive record layer formed over the base sheet and containing a color forming material and a color developing material which undergoes a color forming reaction on contact with the color forming material, and a protective layer formed over the heat-sensitive record layer and comprising a water-soluble resin, the heat-sensitive recording material being characterized in that the protective layer contains at least one member selected from the group consisting of:

(i) polyaluminumhydroxide represented by the formula $$[Al_2(OH)_aX_{6-a}]_n \quad \text{(I)}$$

wherein X represents halogen ion or $NO_3^-$, $0<a<6$ and $1<n\leqq 20$, (ii) polyaluminumhydroxide represented by the formula $$[Al_2(OH)_a(SO_4)_{(6-a)/2}]_n \quad \text{(II)}$$

wherein a and n are as defined above, and (iii) a metal salt of unsaturated aliphatic carboxylic acid represented by the formula $$M_bA_cY_d \quad \text{(III)}$$

wherein M represents a metal having a valence of 2, 3 or 4, A represents unsaturated aliphatic carboxylic acid residue formed by removing one or two hydrogen atoms from the carboxyl group or groups of unsaturated aliphatic monocarboxylic acid or unsaturated aliphatic dicarboxylic acid, Y represents halogen ion, $OH^-$, $SO_4^{2-}$ or $NO_3^-$, b is an integer of 1 or 2, c is an integer of 1 to 8, d is 0 or an integer of 1 to 8, with the proviso that $$ck_2+dk_3=bk_1$$

wherein $k_1$, $k_2$ and $k_3$ are the valences of M, A and Y, respectively.

We conducted extensive research to overcome the drawbacks of conventional heat-sensitive recording materials. In the course of our research, we investigated the protective layer of a heat-sensitive recording material, the layer being formed on the heat-sensitive record layer and comprising a water-soluble resin, and found that improved heat-sensitive recording materials can be prepared by incorporating into the protective layer at least one of the above-specified polyaluminumhydroxides of the formulas (I) and (II) and the above-specified metal salt of unsaturated aliphatic carboxylic acid of the formula (III). The heat-sensitive recording material with the protective layer of water-soluble resin containing at least one of the foregoing polyaluminumhydroxides and metal salt of unsaturated aliphatic carboxylic acid has the advantages of having high resistance to organic solvents, water, plasticizers and the like and thus outstanding image density retentivity, being capable of producing the desired color images even after being subjected to flexographic printing and being free from the likelihood of sticking and from the problem of the residuary substances being piled up on the thermal head. Furthermore, the coating composition for forming the protective layer (hereinafter referred to as "protective layer coating composition")does not have a short pot life and is easy to handle.

It is essential in this invention to incorporate at least one of the polyaluminumhydroxides of the formulas (I) and (II) and the metal salt of unsaturated aliphatic carboxylic acid of the formula (III) into the protective layer of water-soluble resin.

The value n in respect of the polyaluminumhydroxides of the formulas (I) and (II) is preferably more than 1 but not more than 20. When n exceeds 20, the polyaluminumhydroxides have a reduced solubility in water and are difficult to uniformly dissolve or disperse in the aqueous coating composition of water-soluble resin for forming the protective layer, tending not to achieve the desired result, hence undesirable. It is desirable that n be in the range of between not less than 5 and not more than 15.

The value a is more than 0 and less than 6, and preferably $3<a<6$, and more preferably $5<a<6$.

Of these polyaluminumhydroxides, preferable are those of the formula $$[Al_2(OH)_aX_{6-a}]_n \quad \text{(Ia)}$$

wherein X represents halogen ion or $NO_3^-$, $5<a<6$ and $5 \leqq n \leqq 15$.

Of the polyaluminumhydroxides of the formula (Ia), more preferable are those consisting essentially of a compound wherein X is Cl or Br, $a=5.7$ and $n=10$ or a compound wherein X is Cl or Br, $a=5.4$ and $n=5$. The use of these compounds affords a heat-sensitive recording material especially outstanding not only in the suitability for producing the desired complete images on flexographically printed heat-sensitive recording material but also in image density retentility and ability to prevent sticking, hence especially desirable. The compounds wherein $a=5.7$ and $n=10$ and those wherein $a=5.4$ and $n=5$ can also be represented by the formulas $[Al(OH)_3]_{19}.AlX_3$ and $[Al(OH)_3]_9.AlX_3$, respectively.

The polyaluminumhydroxides of the formulas (1) and (II) to be used in the invention can be prepared by conventional processes, for example, by dissolving aluminum hydroxide in an acid such as hydrochloric acid, nitric acid or sulfuric acid, polymerizing the solution with or without using a polymerization initiator such as a compound having sulfuric acid group.

Examples of metals represented by M in the metal salt of unsaturated aliphatic carboxylic acid of the formula (III) and having a valence of 2, 3 or 4 are Al, Zn, Mg, Ca, Sn, Ti, Zr, Fe, Mn, Ni, Cu, Co, Ba, etc. among which Al, Mg, Ca, Zn, Sn and the like are preferred.

Unsaturated aliphatic carboxylic acid residues represented by A are those formed by removing the hydrogen atom from the carboxyl group of unsaturated aliphatic monocarboxylic acid such as acrylic acid, methacrylic acid, sorbic acid and the like, or those formed by removing two hydrogen atoms from the carboxyl groups of unsaturated aliphatic dicarboxylic acid such as maleic acid, itaconic acid and the like.

Of the metal salts of unsaturated aliphatic carboxylic acids of the formula (III), preferable are compounds represented by $$Al_2A_cY_{6-c} \quad \text{(III-1)}$$

(wherein A is the residue obtained by removing the hydrogen atom from the carboxyl group of acrylic acid, methacrylic acid or sorbic acid, Y is halogen ion, $OH^-$ or $NO_3^-$, and c is an integer of 1 to 5), and Mg, Ca, Zn or Sn salt of acrylic acid, methacrylic acid, sorbic acid, maleic acid or itaconic acid.

Of these metal salts of unsaturated aliphatic carboxylic acids, more preferable are compounds represented by the formula $$Al_2A_3Y_3 \quad \text{(III-2)}$$

(wherein A is the residue obtained by removing the hydrogen atom from the carboxyl group of acrylic acid or methacrylic acid, and Y is Cl or Br), or magnesium diacrylate, magnesium dimethacrylate, calcium diacrylate or calcium dimethacrylate since they can highly achieve the desired result of the present invention.

The metal salts of unsaturated aliphatic carboxylic acid of the formula (III) can be prepared by conventional methods such as methods commonly used for preparing multivalent metal salts of carboxylic acids and methods involving reaction of unsaturated carboxylic acid with aluminum chloride or the like.

At least one of the polyaluminumhydroxides of the formulas (I) and (II) and the metal salt of unsaturated aliphatic carboxylic acid of the formula (III) is incorporated into the protective layer according to the invention in an amount of preferably about 2 to about 70% by weight, calculated as solids, based on the water-soluble resin. With less than 2% by weight present, the result of the present invention tends to be attained to a lesser extent, whereas the presence in an amount of more than 70% by weight is likely to significantly increase the viscosity of the protective layer coating composition, hence undesirable. It is more preferred to incorporate at least one of them into the protective layer in an amount of about 5 to about 50% by weight based on the water-soluble resin.

In this invention, the protective layer can be formed by applying to the record layer an aqueous solution containing at least one of the polyaluminumhydroxides of the formulas (I) and (II) and the metal salt of unsaturated aliphatic carboxylic acid of the formula (III) and a water-soluble resin, and drying the resulting layer.

The water-soluble resin to be used for forming the protective layer in this invention is not specifically limited and can be any of resins which are soluble in water and which can give uniform smooth uncured layer when applied in the form of an aqueous solution and give the contemplated cured resin layer when dried.

Such water-soluble resins are conventionally used in the art. Examples of these resins are completely or partially saponified polyvinyl alcohol; acetoacetylated polyvinyl alcohol having acetoacetyl group introduced by reaction of polyvinyl alcohol and diketene or by other procedure; carboxy-modified polyvinyl alcohol which is a reaction product of polyvinyl alcohol and polycarboxylic acid or its anhydride such as fumaric acid, phthalic anhydride, trimellitic anhydride, itaconic anhydride and the like or ester e.g., lower alkyl ester of the reaction product; carboxy-modified polyvinyl alcohol prepared by saponifying a copolymer of vinyl acetate and ethylenically unsaturated carboxylic acid such as maleic acid, fumaric acid, itaconic acid, crotonic acid, acrylic acid, methacrylic acid and the like; sulfonic acid-modified polyvinyl alcohol prepared by saponifying a copolymer of vinyl acetate and olefinsulfonic acid such as ethylenesulfonic acid and allylsulfonic acid or salts (e.g., alkali metal salts) of these acids; olefin-modified polyvinyl alcohol prepared by saponifying a copolymer of vinyl acetate and olefin such as ethylene, propylene, isobutylene, α-octene, α-dodecene, α-octadodecene and the like; nitrile-modified polyvinyl alcohol prepared by saponifying a copolymer of vinyl acetate and nitrile such as acrylonitrile, methacrylonitrile and the like; amide-modified polyvinyl alcohol prepared by saponifying a copolymer of vinyl acetate and amide such as acrylamide, methacrylamide and the like; pyrrolidone-modified polyvinyl alcohol prepared by saponifying a copolymer of vinyl acetate and N-vinyl pyrrolidone; cellulose derivatives such as methyl cellulose, ethyl cellulose, hydroxyethyl cellulose, carboxymethyl cellulose and the like; casein; gum arabic; starches such as oxidized starch, etherified starch, dialdehyde starch, esterified starch and the like; etc.

Of these water-soluble polymers, preferable are polyvinyl alcohols, cellulose derivatives and casein among which acetoacetylated polyvinyl alcohol and carboxy-modified polyvinyl alcohol are more preferred.

A water-dispersible resin can be used as a resin component of the protective layer conjointly with the foregoing water-soluble resin insofar as the conjoint use does not impair the desired result of this invention. Examples of suitable water-dispersible resins are styrene-butadiene copolymer emulsion, vinyl acetate-vinyl chloride-ethylene copolymer emulsion, methacrylatebutadiene copolymer emulsion, etc.

When required, a pigment can be added to the protective layer coating composition in order to improve the printability and the ability to prevent sticking. Examples of useful pigments are inorganic pigments such as calcium carbonate, zinc oxide, aluminum oxide, titanium dioxide, silicon dioxide, barium sulfate, zinc sulfate, talc, kaolin, clay, calcined clay, colloidal silica and the like; and organic pigments such as styrene microballs, nylon powders, polyethylene powders, urea-formaldehyde resin fillers, granular raw starch and the like. The amount of the pigment is about 5 to about 500 parts by weight, preferably about 80 to about 350 parts by weight, per 100 parts by weight of the resin component.

When required, the protective layer coating composition may further contain various auxiliary agents. Examples of useful auxiliary agents are lubricants such as zinc stearate, calcium stearate, stearamide, polyethylene wax, carnauba wax, paraffin wax, ester wax and the like; surfactants (as a dispersant or wetting agent) such as sodium dioctylsulfosuccinate, sodium dodecylbenzenesulfonate, sodium lauryl sulfate, alginate and fatty acid metal salts and the like; ultraviolet absorbers of the benzophenone, triazole or like type; defoaming agents; fluorescent dyes and coloring dyes; etc.

According to this invention, the protective layer coating composition is prepared as an aqueous coating composition and is fully treated with a mixer-agitator such as a mixer, attritor, ball mill and roll mill when so desired, and then applied to a heat-sensitive record layer with a known coater.

After application, the protective layer can be formed in this invention by drying.

The image density retentivity can be enhanced by forming such a protective layer also on the rear side of the heat-sensitive recording material when so desired. Other means known in the field of manufacture of heat-sensitive recording materials can also be adopted. For example, an undercoat may be formed on the base sheet. An adhesive layer may be formed on the rear side of a heat-sensitive recording material so that the resulting recording material can be used as an adhesive label.

The amount of the protective layer coating composition is not specifically limited. However, the desired result will not be achieved fully when the amount is up to 0.1 $g/m^2$ in terms of the weight of the cured coat, whereas if the amount is more than 20 $g/m^2$ based on the weight of the cured coat, the heat-sensitive recording material is likely to have reduced record sensitivity. Accordingly the amount is generally about 0.1 to about 20 $g/m^2$, preferably about 0.5 to about 10 $g/m^2$, calculated as the weight of the cured coat.

The combinations of color forming material and color developing material to be incorporated into the record layer according to this invention are not specifically limited, and can be any of those which can cause a color forming reaction on contact of the two materials when heated. Suitable examples are the combination of a colorless or pale-colored basic dye and an inorganic or organic acidic material, and the combination of ferric stearate or like metal salt of higher fatty acid and gallic acid or like phenol. Further usable in this invention are the combinations of a diazonium compound, a coupler and a basic substance which leads to production of heat-sensitive recording materials adapted to produce color images by application of heat. This invention include these combinations.

The combination of a basic dye and acidic material is especially preferred since the use of this combination achieves remarkable improvement of image density retentivity. A wide variety of colorless or pale-colored dyes are known and include:

Triarylmethane-based dyes, e.g., 3,3-bis(p-dimethylaminophenyl)- 6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6-dimethylaminophthalide, etc.

Diphenylmethane-based dyes, e.g., 4,4'-bis-dimethylaminobenzhydryl benzyl ether, N-halophenyl-leucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho-(6'-methoxybenzo)spiropyran, 3-propylspiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino- 7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, etc.

Examples of inorganic or organic acidic materials which undergo a color forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-phenoxy-phenol, α-naphthol, β-naphthol, 4-hydroxyacetophenone, 4-tert-octylcatechol, 2,2'-dihydroxydiphenol, 2,2'-methylenebis(4-methyl-6-tert-isobutylphenol), 4,4'-isopropylidenebis(2-tert-butylphenol), 4,4'-sec-butylidenediphenol, 4-phenylphenol, 4,4'-isopropylidene-diphenol (i.e., Bisphenol A), 2,2'-methylene-bis(4-chlorophenol), hydroquinone, 4,4'-cyclohexylidenediphenol, 4-hydroxybenzoic acid benzyl ester, 4-hydroxyphthalic acid dimethyl ester, hydroquinone monobenzyl ether, novolak phenol resins and phenolic polymers; aromatic carboxylic acids such as benzoic acid, p-tertbutylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tertbutylsalicylio acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid and 3,5-di-(α-methylbenzyl)salicylic acid; also, salts of such phenolic compounds or aromatic carboxylic acids with polyvalent metals such as zinc, magnesium, aluminum, calcium, titanium, manganese, tin and nickel.

For the preparation of the heat-sensitive recording material of the present invention, the proportions of the color forming material and the color developing material to be incorporated into the record layer are suitably determined according to the kinds of these materials and are not particularly limited. For example, when the combination of a colorless or pale-colored basic dye and an inorganic or organic acidic material is used, about 1 to about 50 parts by weight, preferably about 1 to about 10 parts by weight, of the acidic material is used per part by weight of the basic dye.

These materials are formulated into a heat-sensitive coating composition generally with use of water as a dispersion medium and a stirring or pulverizing device, such as a ball mill, attritor or sand mill, by dispersing the two materials at the same time or separately.

Usually the coating composition has incorporated therein a binder, such as starches, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer salt, styrene-butadiene copolymer emulsion or the like. The binder is used in an amount of about 10 to about 70% by weight, preferably about 15 to about 50% by weight, based on the total solids content of the composition.

Various auxiliary agents can be further admixed with the coating composition. Examples of useful auxiliary agents are dispersants such as sodium diocytylsulfosuccinate, sodium dodecylbenzenesulfonate, sodium lauryl sulfate, alginate and fatty acid metal salts; ultraviolet absorbers of the benzophenone, triazole or like type; defoaming agents; fluorescent dyes and coloring dyes; etc.

Further when desired, other additives can be incorporated into the composition. Examples of useful additives are lubricants such as zinc stearate, calcium stearate, polyethylene wax, carnauba wax, paraffin wax and ester wax; inorganic pigments such as kaolin, clay, talc, calcium carbonate, calcined clay, titanium oxide, diatomaceous earth, fine granular anhydrous silica and activated clay; and sensitizers such as stearic acid amide, stearic acid methylene-bisamide, oleic acid amide, palmitic acid amide, sperm oleic acid amide and coconut fatty acid amide; etc.

The method of forming the record layer of the heat-sensitive recording material of the invention is not particularly limited but can be any of conventional methods. For example, the heat-sensitive coating composition is applied to the base sheet by air knife coating, blade coating, short dwell coating or like means and then dried. The amount of the coating composition, which is also not particularly limited, is generally about 2 to about 12 g/m$^2$, preferably about 3 to about 10 g/m$^2$, based on dry weight.

According to this invention, any of known sheets are usable as base sheets. Typical of such sheets are paper, paper of synthetic fiber, synthetic resin film, etc., among which paper is most preferred in terms of costs, coating properties, etc.

The present invention will be described below in greater detail with reference to the following examples, to which the invention of course is in no way limited. In these examples, the parts and the percentages are all by weight unless otherwise specified.

EXAMPLE 1

(1) Preparation of mixture A

| | |
|---|---|
| 3-(N—Cyclohexyl-N—methylamino)-6-methyl-7-phenylaminofluoran | 10 parts |
| 5% Aqueous solution of methyl cellulose | 5 parts |

-continued

| | |
|---|---|
| Water | 30 parts |

The above mixture was pulverized by a sand mill to a mean particle size of 3 μm.

(2) Preparation of mixture B

| | |
|---|---|
| Benzyl 4-hydroxybenzoate | 20 parts |
| 5% Aqueous solution of methyl cellulose | 5 parts |
| Water | 55 parts |

The above mixture was pulverized by a sand mill to a mean particle size of 3 μm.

(3) Formation of record layer

A 45 part-portion of the mixture A, 80 parts of the mixture B, 50 parts of 20% aqueous solution of oxidized starch and 10 parts of water were mixed together and agitated to obtain a coating composition. The composition was applied to non-coated paper weighing 50 g/m$^2$ in an amount of 6 g/m$^2$ based on dry weight and then dried to obtain a heat-sensitive recording paper.

(4) Formation of protective layer

A protective layer coating composition given below was applied onto the record layer of the paper in an amount of 5 g/m$^2$ calculated as the weight of cured coating, and the layer was dried to obtain a heat-sensitive recording paper having a protective layer.

| | |
|---|---|
| 15% Aqueous solution of polyaluminum-hydroxide consisting essentially of $[Al(OH)_3]_{19}.AlCl_3$ (trademark "Paho#2S", product of ASADA KAGAKU KOGYO KABUSHIKI KAISHA, Japan) | 100 parts |
| 8% Aqueous solution of polyvinyl alcohol (trademark "PVA 117", product of KURARAY CO., LTD., Japan) | 1000 parts |
| Calcium carbonate (trademark "SOFTON 1800", product of BIHOKU FUNKA KABUSHIKI KAISHA, Japan) | 100 parts |
| Water | 100 parts |

EXAMPLE 2

A heat-sensitive recording paper having a protective layer was prepared in the same manner as in Example 1 with the exception of using the following protective layer coating composition. The term "AA" stands for acrylic acid residue, and this abbreviation will hereinafter be used in the same manner.

| | |
|---|---|
| 15% Aqueous solution of $Al_2(AA)_3Cl_3$ (trademark "P-3", product of ASADA KAGAKU KOGYO KABUSHIKI KAISHA) | 100 parts |
| 8% Aqueous solution of polyvinyl alcohol (trademark "PVA117", product of KURARAY, CO., LTD.) | 1000 parts |
| Calcium carbonate ("SOFTON 1800", product of BIHOKU FUNKA KABUSHIKI KAISHA) | 100 parts |
| Water | 100 parts |

EXAMPLE 3

A heat-sensitive recording paper having a protective layer was prepared in the same manner as in Example 2 with the exception of using 100 parts by weight of 15% aqueous solution of magnesium diacrylate (product of ASADA KAGAKU KOGYO KABUSHIKI KAISHA) in place of $Al_2(AA)_3Cl_3$ contained in the protective layer coating composition of Example 2.

EXAMPLE 4

A heat-sensitive recording paper having a protective layer was prepared in the same manner as in Example 1 with the exception of using the following protective layer coating composition.

| | |
|---|---|
| 15% Aqueous solution of polyaluminum-hydroxide consisting essentially of $[Al(OH)_3]_9.AlCl_3$ (trademark "Aluminol ACH", product of ASADA KAGAKU KOGYO KABUSHIKI KAISHA) | 100 parts |
| 8% Aqueous solution of polyvinyl alcohol (trademark "PVA 117", product of KURARAY CO., LTD.) | 1000 parts |
| Calcium carbonate (trademark "SOFTON 1800", product of BIHOKU FUNKA KABUSHIKI KAISHA) | 100 parts |
| Water | 100 parts |

EXAMPLE 5

A heat-sensitive recording paper having a protective layer was prepared in the same manner as in Example 1 with the exception of using acetoacetylated polyvinyl alcohol (trademark "Gohsefimer Z-200", product of NIHON GOSEI KABUSHIKI KAISHA, Japan) in place of polyvinyl alcohol ("PVA 117")used for forming the protective layer coating composition.

EXAMPLE 6

A heat-sensitive recording paper having a protective layer was prepared in the same manner as in Example 2 with the exception of using acetoacetylated polyvinyl alcohol ("Gohsefimer Z-200") in place of polyvinyl alcohol ("PVA 117") used for forming the protective layer coating composition.

COMPARISON EXAMPLE 1

A heat-sensitive recording paper having a protective layer was prepared in the same manner as in Example 1 with the exception of using the following protective layer coating composition.

| | |
|---|---|
| 8% Aqueous solution of polyvinyl alcohol (trademark "PVA 117", product of KURARAY CO., LTD.) | 1000 parts |
| Calcium carbonate (trademark "SOFTON 1800", product of BIHOKU FUNKA KABUSHIKI KAISHA) | 100 parts |
| Water | 100 parts |

COMPARISON EXAMPLE 2

A heat-sensitive recording paper having a protective layer was prepared in the same manner as in Example 1 with the exception of using the following protective layer coating composition.

| | |
|---|---|
| 15% Aqueous dispersion of $Al(OH)_3$ | 100 parts |
| 8% Aqueous solution of polyvinyl alcohol (trademark "PVA 117", product of KURARAY CO., LTD.) | 1000 parts |
| Calcium carbonate (trademark "SOFTON 1800", product of BIHOKU FUNKA KABUSHIKI KAISHA) | 100 parts |

-continued

| | |
|---|---|
| Water | 100 parts |

COMPARISON EXAMPLE 3

A heat-sensitive recording paper having a protective layer was prepared in the same manner as in Example 1 with the exception of using the following protective layer coating composition.

| | |
|---|---|
| 40% Aqueous solution of glyoxal | 40 parts |
| 8% Aqueous solution of polyvinyl alcohol (trademark "PVA 117", product of KURARAY CO., LTD.) | 1000 parts |
| Calcium carbonate (trademark "SOFTON 1800", product of BIHOKU FUNKA KABUSHIKI KAISHA) | 100 parts |
| Water | 100 parts |

The 9 kinds of heat-sensitive recording papers each having a protective layer were caused to form color images thereon with use of a thermal printer (product of TEXAS INSTRUMENT CORP., U.S.A., Model PC-100A). The degrees of sticking was evaluated according to the following criteria. Table 1 below shows the results.

A: Sticking was not caused.

B: A slight degree of sticking occurred, but posing no practical problem.

C: A marked degree of sticking occurred, posing practical problem.

The heat-sensitive recording papers obtained above were pressed to the thermal plate of a tester (product of TOYO SEIKI KABUSHIKI KAISHA, Japan) at 120° C. under a pressure of 2 kg/cm$^2$ for 10 seconds to develop color image thereon, and the initial image density was measured by a Macbeth densitometer (product of Macbeth Corp., U.S.A., Model RD-100R). Table 1 below shows the results.

The heat-sensitive recording papers were also tested for resistance to plasticizers, resistance to water and suitability for producing images on a flexographically printed heat-sensitive recording material by the following methods. Table 1 below also shows the results.

Resistance to plasticizers

The heat-sensitive recording papers were heated by the thermal plate to form color images thereon. Vinyl chloride wrapping film (product of MITSUI TOATSU KABUSHIKI KAISHA, Japan) was wound 3-fold around a polypropylene pipe (40 mm in diameter). The film thus wound was covered with each of the heat-sensitive recording papers with the side of color images outwardly directed. Then vinyl chloride wrapping film was further wound 5-fold around the heat-sensitive recording paper. The image density of the paper was measured 72 hours thereafter by a Macbeth densitometer. (The greater the value thus obtained, the higher the resistance to plasticizers.)

Resistance to water

Each of the heat-sensitive recording papers with the images formed was immersed in water for 15 hours and dried by air and then the image density was measured by a Macbeth densitometer. (The greater the value thus obtained, the higher the resistance to water.)

Suitability for producing images on flexographically printed heat-sensitive recording paper A flexographic ink (trademark "SUPER DYEFLEX PROCESS BENI", product of DAINIPPON INK & CHEMICALS INC., Japan) was applied to each of the heat sensitive recording papers in an amount of 2 g/cm$^2$. The ink applied was dried by air for 10 hours for curing. Lattice-pattern images were produced by a thermal facsimile (product of Mitsubishi Electric Corp., Japan, Model MELFAS-1500) and the distinctness of the images were evaluated according to the following rating.

A: The images were distinct and the recorded portion had no projection nor recess;

B: The images were indistinct and the recorded portion had projections and recesses.

TABLE 1

| | Sticking | Initial image density | Resistance to plasticizers | Resistance to water | Suitability for forming images on flexographically printed material |
|---|---|---|---|---|---|
| Example | | | | | |
| 1 | A | 1.30 | 1.27 | 1.28 | A |
| 2 | A | 1.30 | 1.26 | 1.26 | A |
| 3 | B | 1.29 | 1.15 | 1.27 | A |
| 4 | B | 1.30 | 1.15 | 1.27 | A |
| 5 | A | 1.30 | 1.29 | 1.30 | A |
| 6 | A | 1.30 | 1.29 | 1.27 | A |
| Comp. Ex. | | | | | |
| 1 | C | 1.29 | 0.84 | 0.84 | B |
| 2 | C | 1.30 | 0.91 | 0.90 | B |
| 3 | B | 1.30 | 0.92 | 0.92 | B |

Table 1 shows that the heat-sensitive recording materials of this invention are free from sticking and have outstanding image density retentivity and improved suitability for producing images on flexographically printed heat-sensitive recording materials.

We claim:

1. A heat-sensitive recording material comprising a base sheet, a heat-sensitive record layer formed over the base sheet and containing a color forming material and a color developing material which undergoes a color forming reaction on contact with the color forming material, and a protective layer formed over the heat-sensitive record layer and comprising a water-soluble resin, the heat-sensitive recording material being characterized in that the protective layer contains at least one member selected from the group consisting of:

(i) polyaluminumhydroxide represented by the formula $$[Al_2(OH)_aX_{6-a}]_n \quad (I)$$

wherein X represents halogen ion or $NO_3^-$, $0<a<6$ and $1<n\leqq 20$, (ii) polyaluminumhydroxide represented by the formula $$[Al_2(OH)_a(SO_4)_{(6-a)/2}]_n \quad (II)$$

wherein a and n are as defined above, and (iii) a metal salt of unsaturated aliphatic carboxylic acid represented by the formula $$M_bA_cY_d \quad (III)$$

wherein M represents a metal having a valence of 2, 3 or 4, A represents unsaturated aliphatic carboxylic acid residue formed by removing one or two hydrogen atoms from the carboxyl group or groups of unsaturated aliphatic monocarboxylic acid or unsaturated aliphatic dicarboxylic acid, Y represents halogen ion, $OH^-$, $SO_4^{2-}$ or $NO_3^-$, b is an integer of 1 or 2, c is an integer of 1 to 8, d is 0 or an integer of 1 to 8, with the proviso that $$ck_2+dk_3=bk_1$$

wherein $k_1$, $k_2$ and $k_3$ are the valences of M, A and Y, respectively.

2. A heat-sensitive recording material according to claim 1 wherein the protective layer contains a polyaluminumhydroxide represented by the formula $$[Al_2(OH)_aX_{6-a}]_n \quad (Ia)$$

wherein X represents halogen ion or $NO_3^-$, $5<a<6$ and $5\leqq n\leqq 15$.

3. A heat sensitive recording material according to claim 2 wherein the polyaluminumhydroxide is $[Al(OH)_3]_{19}.AlCl_3$ or $[Al(OH)_3]_9.AlCl_3$.

4. A heat-sensitive recording material according to claim 1 wherein the metal represented by M in the metal salt of unsaturated aliphatic carboxylic acid of the formula (III) is one selected from the group consisting of Al, Zn, Mg, Ca, Sn, Ti, Zr, Fe, Mn, Ni, Cu, Co and Ba.

5. A heat-sensitive recording material according to claim 1 wherein the unsaturated aliphatic carboxylic acid residue represented by A in the metal salt of unsaturated aliphatic carboxylic acid of the formula (III) is a residue formed by removing the hydrogen atom from the carboxyl group of acrylic acid, methacrylic acid or sorbic acid, or a residue formed by removing the two hydrogen atoms from the carboxyl groups of maleic acid or itaconic acid.

6. A heat-sensitive recording material according to claim 1 wherein the protective layer contains a compound represented by the formula $$Al_2A_cY_{6-c} \quad (III\text{-}1)$$

(wherein A represents a residue formed by removing the hydrogen atom from the carboxyl group of acrylic acid, methacrylic acid and sorbic acid, Y represents halogen ion, $OH^-$ or $NO_3^-$, and c is an integer of 1 to 5), or magnesium, calcium, zinc or tin salt of acrylic acid, methacrylic acid, sorbic acid, maleic acid or itaconic acid.

7. A heat-sensitive recording material according to claim 1 wherein the protective layer contains a compound represented by the formula $$Al_2A_3Y_3 \quad (III\text{-}2)$$

(wherein A represents a residue formed by removing hydrogen atom from the carboxyl group of acrylic acid or methacrylic acid, and Y represents Cl or Br), or magnesium diacrylate, magnesium dimethacrylate, calcium diacrylate or calcium dimethacrylate.

8. A heat-sensitive recording material according to claim 1 wherein the protective layer contains at least one member selected from the group consisting of polyaluminumhydroxide of the formula (I), polyaluminumhydroxide of the formula (II) and a metal salt of unsaturated aliphatic carboxylic acid of the formula (III) in an amount of about 2 to about 70% by weight, calculated as solids, based on the water-soluble resin.

9. A heat-sensitive recording material according to claim 1 wherein the protective layer contains an inorganic pigment selected from the group consisting of calcium carbonate, zinc oxide, aluminum oxide, titanium dioxide, silicon dioxide, barium sulfate, zinc sulfate, talc, kaolin, clay, calcined clay and colloidal silica, and/or an organic pigment selected from the group consisting of styrene microballs, nylon powders, polyethylene powders, urea-formaldehyde resin fillers and granular raw starch.

* * * * *